US006074073A

United States Patent [19]

Huang

[11] Patent Number: 6,074,073

[45] Date of Patent: Jun. 13, 2000

[54] EXTENSION DEVICE FOR DECORATIVE LAMPS

[76] Inventor: Shun-Feng Huang, No. 13, Lane 84, Nei Hu Road, Hsin Chu City, Taiwan

[21] Appl. No.: 09/110,453

[22] Filed: Jul. 7, 1998

[51] Int. Cl.[7] ..... H01R 33/00; F21V 21/00

[52] U.S. Cl. ..... 362/226; 362/249; 362/391; 362/806; 362/252

[58] Field of Search ..... 362/226, 252, 362/249, 391, 806, 807, 808

[56] References Cited

U.S. PATENT DOCUMENTS 5,154,508 10/1992 Ahroni ..... 362/226

5,339,232 8/1994 Lin ..... 362/226

5,829,865 11/1998 Ahroni ..... 362/226

*Primary Examiner*—Cassandra Spyrou

*Assistant Examiner*—Darren E. Schuberg

*Attorney, Agent, or Firm*—Rosenberg, Klein & Lee

[57] ABSTRACT

An extension device for decorative lamps includes a position base, a connection base, a lamp socket and conductors. The lamps and the power wires can be combined in various shapes and configurations by means of the extension devices. Then all power wires are bundled and fitted in a tubular base, which can then be stabilized with a bottom base or a position rod able to insert in something to stabilize the whole decorative lamps combined with the extension devices.

6 Claims, 7 Drawing Sheets

EXTENSION DEVICE FOR DECORATIVE LAMPS

BACKGROUND OF THE INVENTION

This invention relates to an extension device for decorative lamps, particularly to one including a position base, a connect base , a lamp socket, and a conductor as main components, enabling two power wires of a decorative lamp connected to those of another one, with many decorative lamps connected to one another forming various shapes or configurations to satisfy various demands of users.

A conventional decorative lamp, as shown in FIG. 7, includes a lamp socket 9, two power wires A, B connected to the bottom of the lamp socket 9, a lamp C inserted in the lamp socket 9, and a hanger 91 formed on an outer surface of the lamp socket 9.

In using, the power wire A has its one end combined to the lamp socket 9 also connected to the power wire B. Then a pair of lamp sockets 9 connected to the power wires A, B are placed in parallel , and the power wire A or B of each decorative lamp is hooked in the hanger 91, forming decorative lamp net as shown in FIG. 8. As the shape of the combined decorative lamps is limited by the structure of the decorative lamp, only in kind of a net shape but unable to cope with various demands of consumers.

SUMMARY OF THE INVENTION

This invention has been devised to offer a kind of extension device for decorative lamps, which permits the power wires of different decorative lamps extend in various angles, to be combined with each other so that many decorative lamps may be connected to one another in various shapes or configurations to cope with various demands of consumers.

BRIEF DESCRIPTION OF DRAWINGS

This invention will be better understood by referring to the accompanying drawings, wherein:.

DETAILED DESCRIPTION OF THE PREFERRED EMBODIMENT

Figure 1:
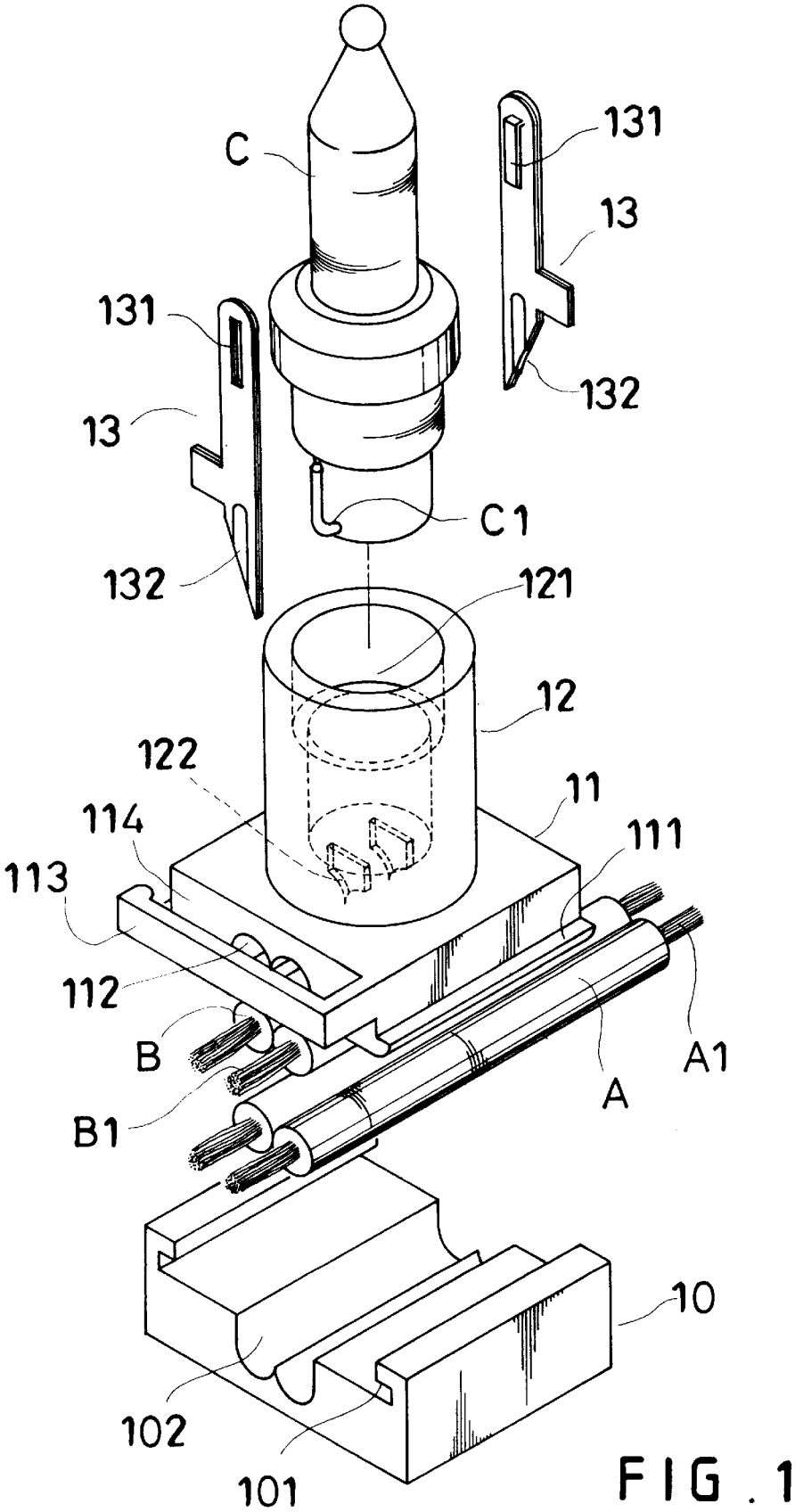
FIG. 1 is an exploded perspective view of an extension device for decorative lamps of the present invention.

A preferred embodiment of an extension device 1 for a decorative lamp includes a position base 10, a connection base 11, a lamp socket 12 and conductors 13 as main components.

The position base 10 is made integral, having a U shape, a lengthwise groove 101 respectively formed at two sides and facing internally to each other, and a lengthwise W-shaped groove 102 formed in the center for placing a power wires A and a covered (not naked) iron wire A2 side by side therein.

The connection base 11 is shaped as a square disc, located on the base 10, having a projecting ridge 111 respectively extending from two opposite sides to engage the groove 101 of the position base 10, a W-shaped lengthwise groove 112 formed in the center of the lower bottom surface for placing a power wire B and a covered (not naked) iron wire B2 side by side therein, and an L-shaped arm 113 formed to extend from a lateral side, and an elongate opening 114 formed between the L-shaped arm 113 and the lateral side of the connect base 11.

The lamp socket 12 is positioned on the connection base 11, having a center hollow chamber 121 and two parallel vertical holes 122 formed in the bottom wall and extending through the connection base 11 down.

The conductors 13 are flat, fitting in the two parallel vertical holes 122 of the lamp socket 12, having an upper portion 131 with and a lower triangular portion 132 with a pointed end.

Figure 2:
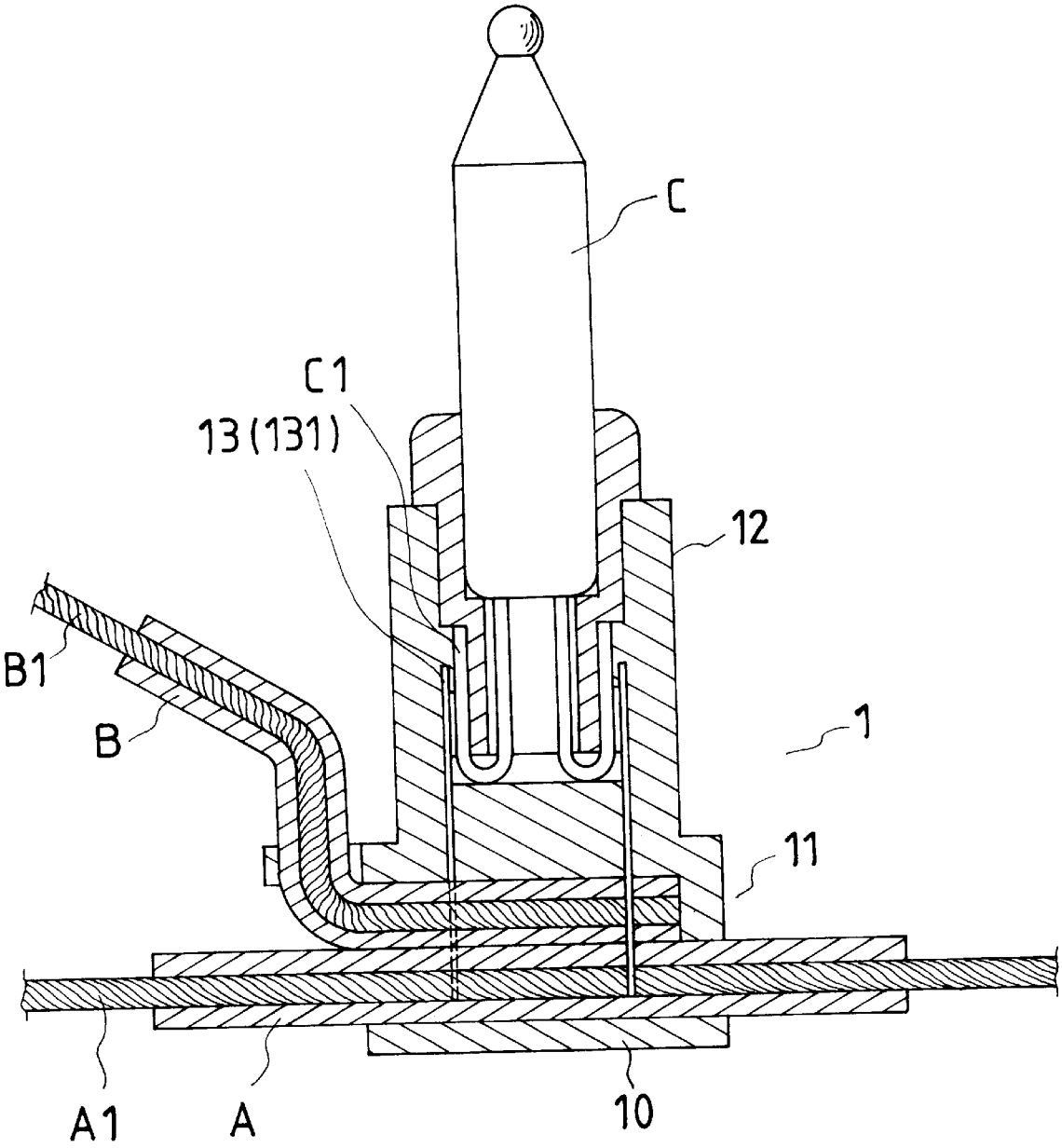
FIG. 2 is a cross-sectional view of the extension device for decorative lamps of the present invention.
Figure 3:
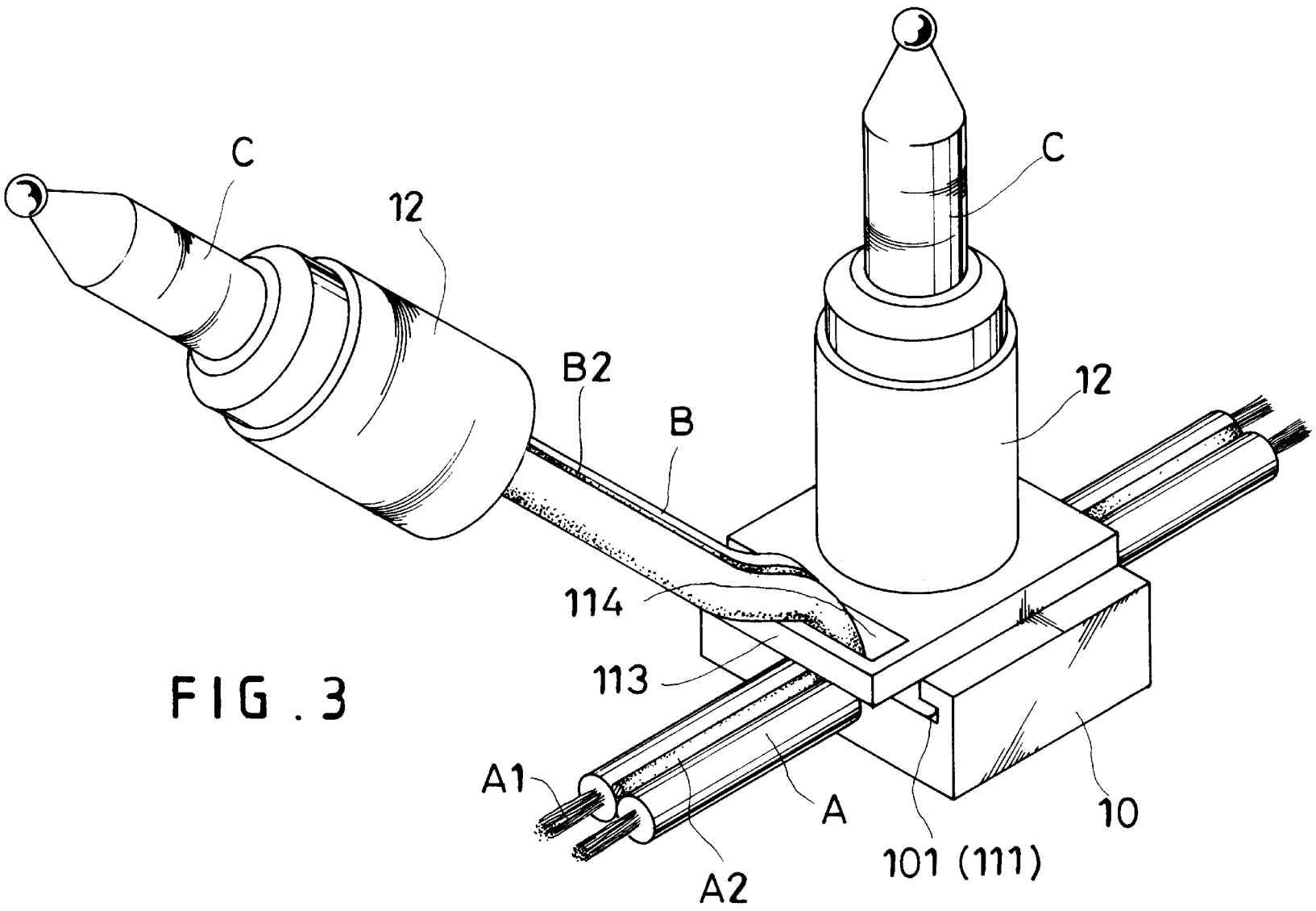
FIG. 3 is a perspective view of the extension device used to connect together two decorative lamps of the present invention.

In assembling, as shown in FIG. 2, firstly the position base 10 and the connection base 11 are combined together, with the projecting ridges 111 engaging the lengthwise grooves 101, with the power wires A, B placed side by side with the covered iron wires A2, B2 in the lengthwise W-shaped groove 102 and the lengthwise W-shaped grooves 112 respectively. Then the conductors 13 are inserted through the parallel vertical holes 122, with the pointed end of their lower portions 132 sticking in the cores A1, B1 of the power wires A, B. Next, the lamp C is put in the lamp socket 12, with a conductor portion C1 to contact the upper portion 131 of the conductors 13 so as to make up a circuit with the power wires A, B, the conductors 13 and the lamp C. Then the other ends of the power wires A, B may be connected to another lamp socket 12 for another lamp C . The power wire B may be made to pass through opening 114 to be positioned in the W-shaped groove 112, and then bent up to a certain angle, as shown in FIG. 3.

After the extension device 1 is combined with the power wire A of each decorative lamp, all of the power wires A and the covered iron wire A2 may be bundled and stabilized in a tubular base 2, which has female threads 20 for engaging male threads 30 or 40 of a bottom base 3 or a position rod 4. The position rod 4 has a lower tapered portion 41 to insert in something (such as the ground) where the decorative lamps are installed.

Figure 4:
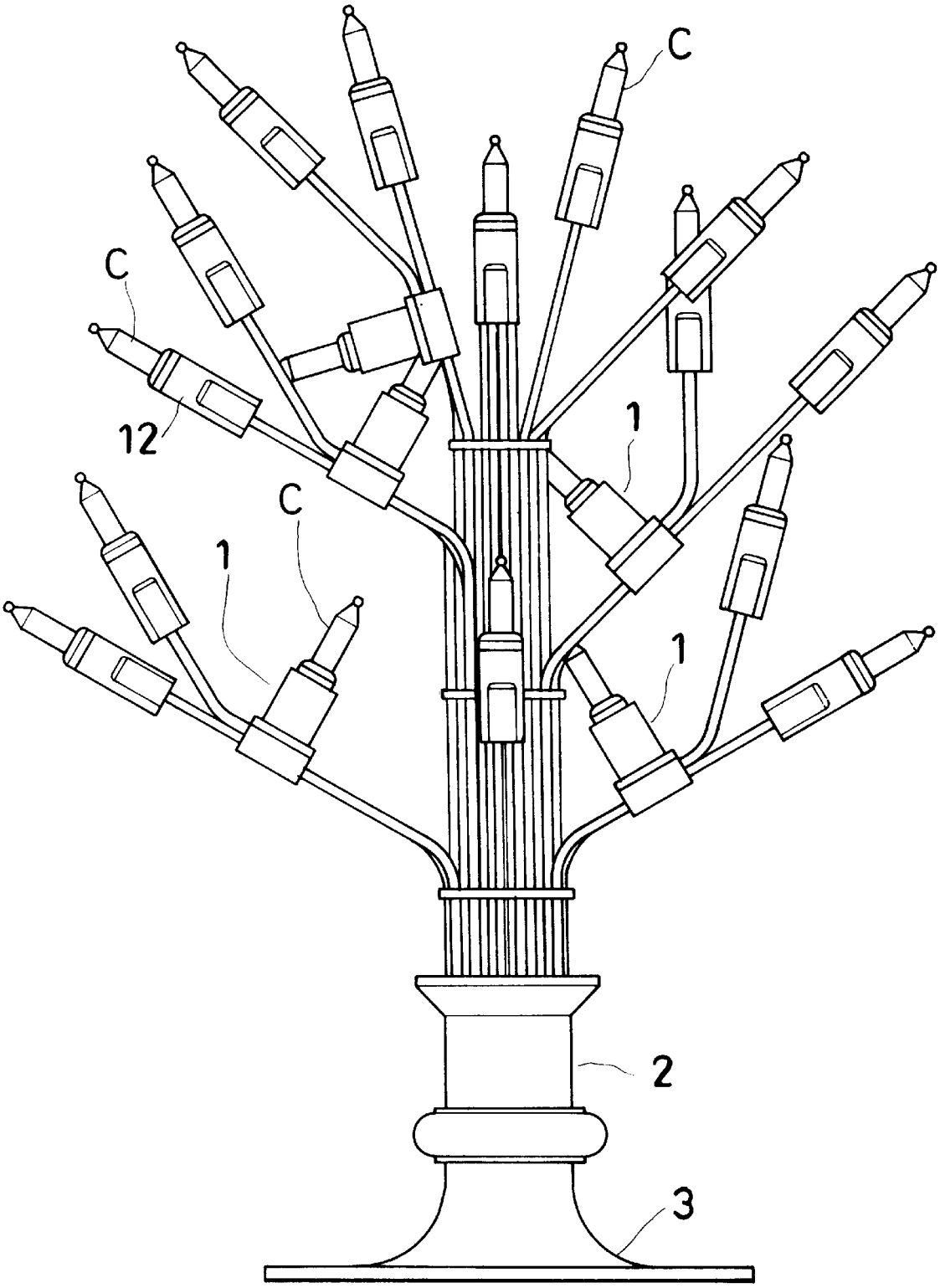
FIG. 4 is a side view of the extension devices used to connect many decorative lamps in a first kind of shape of the present invention.
Figure 5:
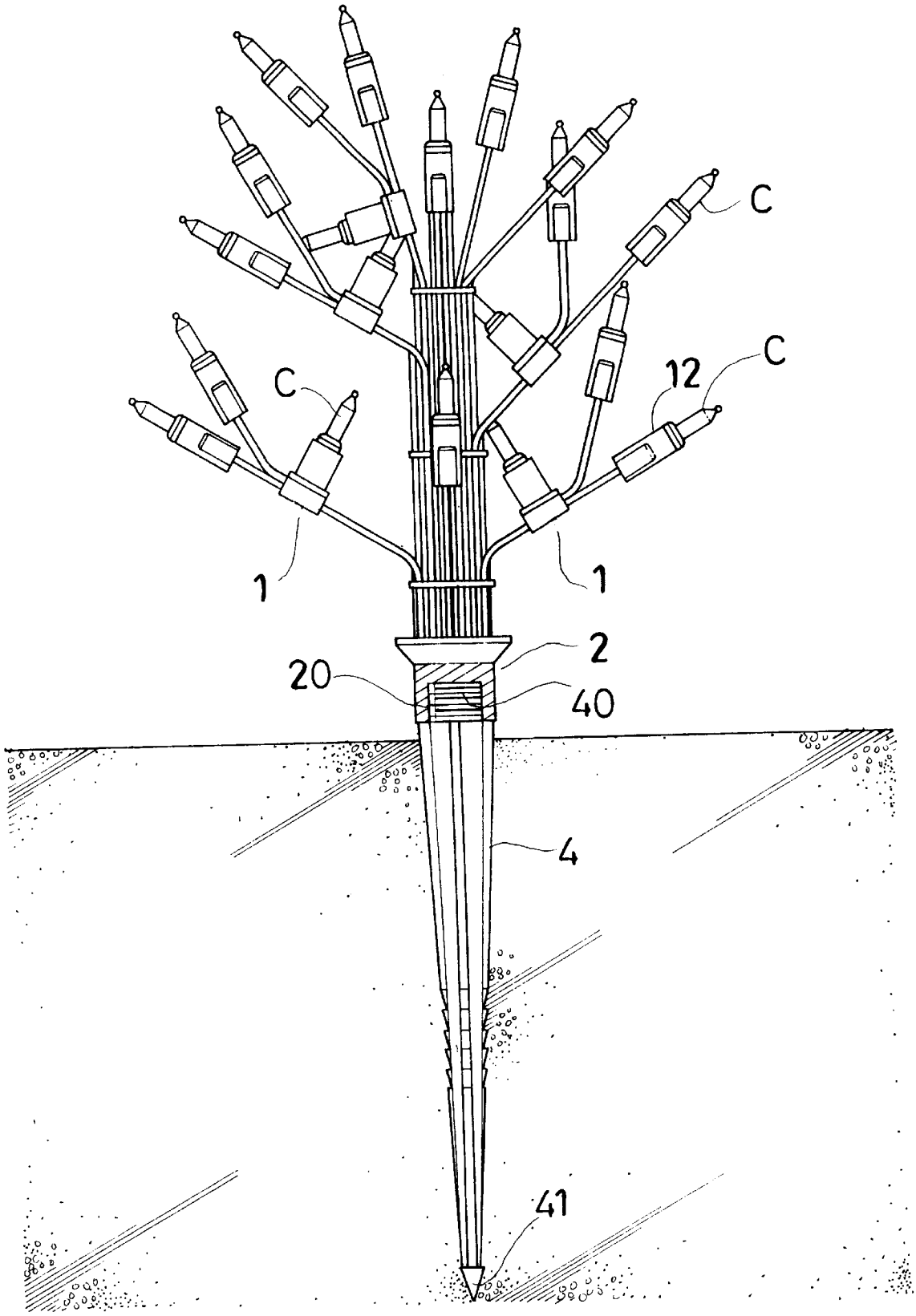
FIG. 5 is side view of the extension devices used to connect many decorative lamps in a second kind of shape of the present invention.
Figure 6:
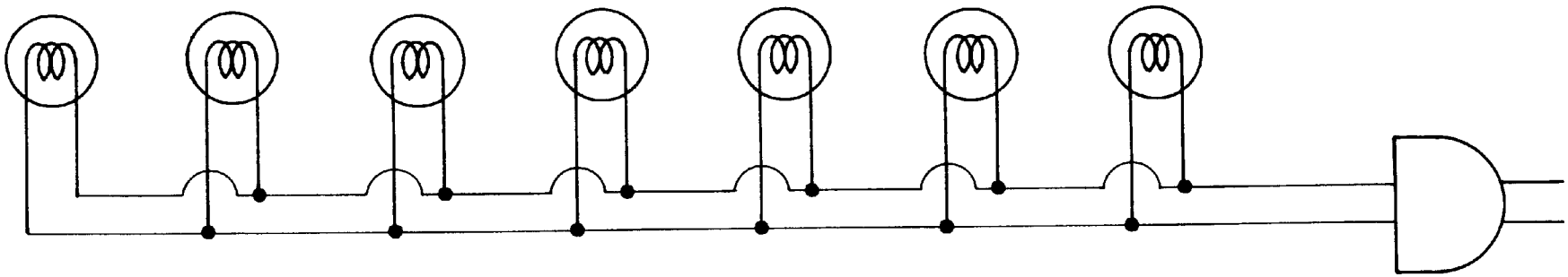
FIG. 6 is diagram of the circuit of a number of decorative lamps connected by the extension devices of the present invention.
Figure 8:
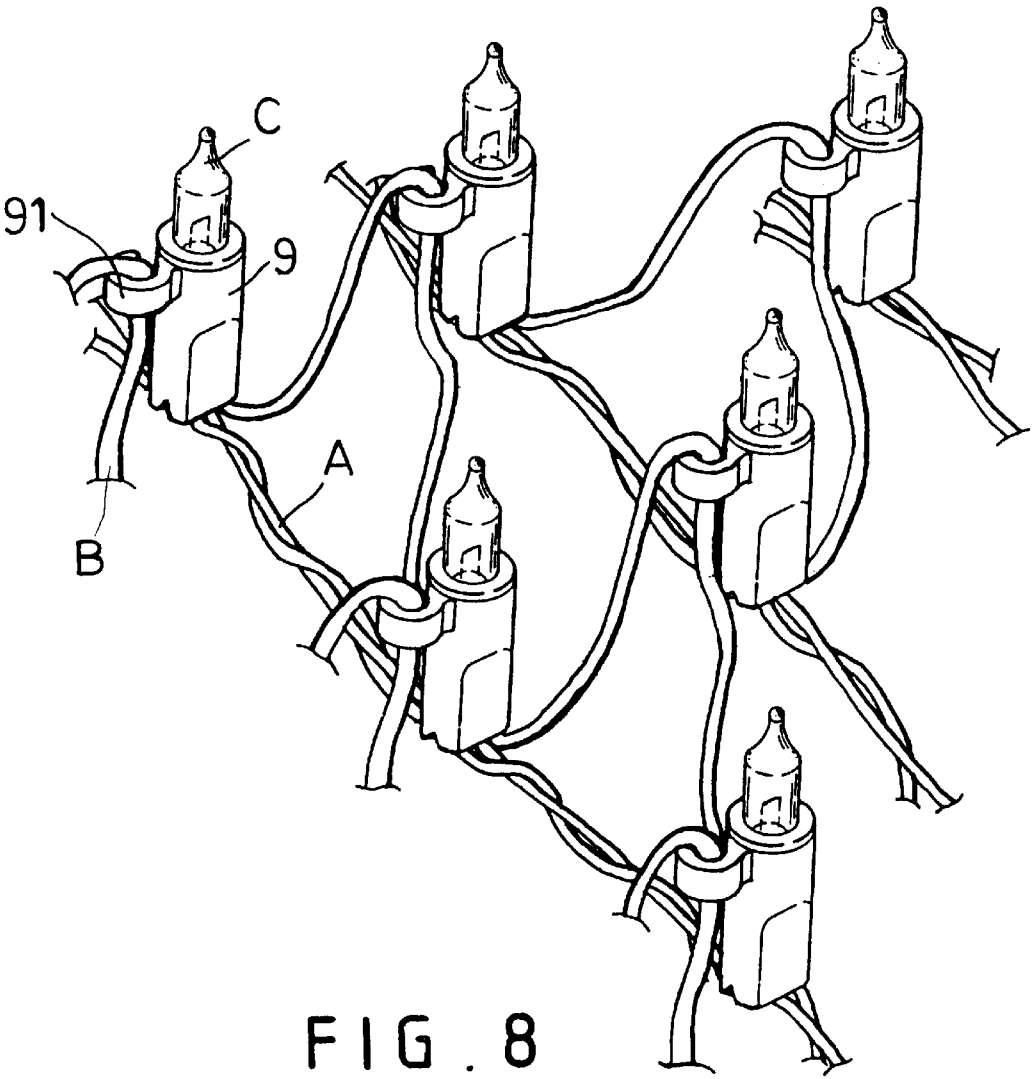
FIG. 8 (PRIOR ART)
FIG. 8 is a perspective view of the conventional decorative lamps connected to form a lamp net.
Figure 7:
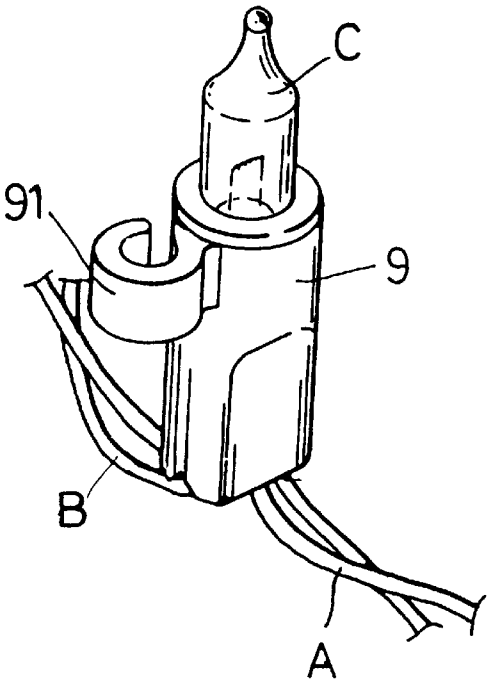
FIG. 7 (PRIOR ART)
FIG. 7 a perspective view of a conventional decorative lamp.

Combination of the decorative lamps by means of the extension devices of the present invention are shown in two ways as shown in FIGS. 4 and 5. FIG. 6 shows a diagram of the power wires A utilizing the tubular base 2, with each power wire A is connected to a common power wire in parallel.

The extension device in the invention can connect another power wire to a power wire of each decorative lamp, and further the covered iron wires A2, B2 may be laid side by side the power wires A, B so that the power wires A, B may be bent and kept in any direction by means of the covered iron wires A2, B2 so as to form variously shaped nets of decorative lamps, improving the disadvantage of the conventional decorative lamps.

What is claimed is:

1. An extension device for decorative lamps comprising a position base, a connection base, a lamp socket and conductors;

said position base having two opposite grooves respectively formed in two sides and facing internally, to each other, a W-shaped lengthwise groove formed in the center of an upper surface;

said connection base having a projecting ridge formed respectively to extend from two opposite sides, and a flat upper surface for placing said lamp socket thereon;

said lamp socket located on said connection base, having two parallel holes formed in the bottom for two of said conductors to fit therein;

said conductors respectively having a flat shape, an upper portion, a lower triangular portion with a pointed end, passing through down said two parallel holes of said lamp socket to insert in cores of power wires placed in said lengthwise W-shaped grooves of said position base so as to connect to said power wire; and, said extension device of a decorative lamp possible to connect other power wires of another decorative lamp for combining a plurality of decorative lamps into a kind of various shapes.

2. The extension device for decorative lamps as claimed in claim 1, wherein said connect base has a support arm extending from a side and forming an elongate opening with said side for power wires to pass through and supporting said power wires.

3. The extension device for decorative lamps as claimed in claim 1, wherein a lamp may fit in a hollow chamber of said lamp socket, with a conductor portion of said lamp contacting an upper end of said conductor for electric current to reach said lamp.

4. The extension device for decorative lamps as claimed in claim 1, wherein a tubular base is further provided to permit all of said power wires bundled in an interior of said tubular base so as to connect in parallel with a common power wire.

5. The extension device for decorative lamps as claimed in claim 4, wherein a bottom base or a position rod is further provided under said tubular base for stabilize a whole decorative lamp net.

6. The extension device for decorative lamps as claimed in claim 5, wherein said position rod is shaped tapered with a lower pointed end for inserting in something for stabilizing said position rod.

* * * * *